United States Patent [19]

Liebe

[11] Patent Number: 4,651,048

[45] Date of Patent: Mar. 17, 1987

[54] HIGH PRESSURE DISCHARGE LAMP WITH ARC TUBE HEAT SHIELD

[75] Inventor: Johan Liebe, Eindhoven, Netherlands

[73] Assignee: U.S. Philips Corporation, New York, N.Y.

[21] Appl. No.: 846,495

[22] Filed: Mar. 26, 1986

Related U.S. Application Data

[63] Continuation of Ser. No. 559,590, Dec. 8, 1983, abandoned.

[30] Foreign Application Priority Data

Dec. 22, 1982 [NL] Netherlands ..... 8204937

[51] Int. Cl.[4] ..... H01J 61/30; H01J 61/52

[52] U.S. Cl. ..... 313/25; 313/44; 313/634; 313/42

[58] Field of Search ..... 313/25, 43, 44, 634, 313/42

[56] References Cited

U.S. PATENT DOCUMENTS

| | | | |
|---|---|---|---|
| 2,315,286 | 3/1943 | Hays, Jr. et al. | 313/25 X |
| 4,037,129 | 7/1977 | Zack et al. | 313/594 |
| 4,173,728 | 11/1979 | Witting | 313/638 X |
| 4,230,964 | 10/1980 | Bhalla | 313/635 X |
| 4,423,353 | 12/1983 | Ogata et al. | 313/634 X |

*Primary Examiner*—Palmer C. DeMeo

*Attorney, Agent, or Firm*—David R. Treacy

[57] ABSTRACT

A high-pressure discharge lamp provided with a cylindrical shield near an end and around and at a certain distance from the discharge envelope. The cylindrical shield is electrically insulated from current-conveying parts, so that migration of filling constituents through the wall of the discharge envelope is counteracted.

10 Claims, 1 Drawing Figure

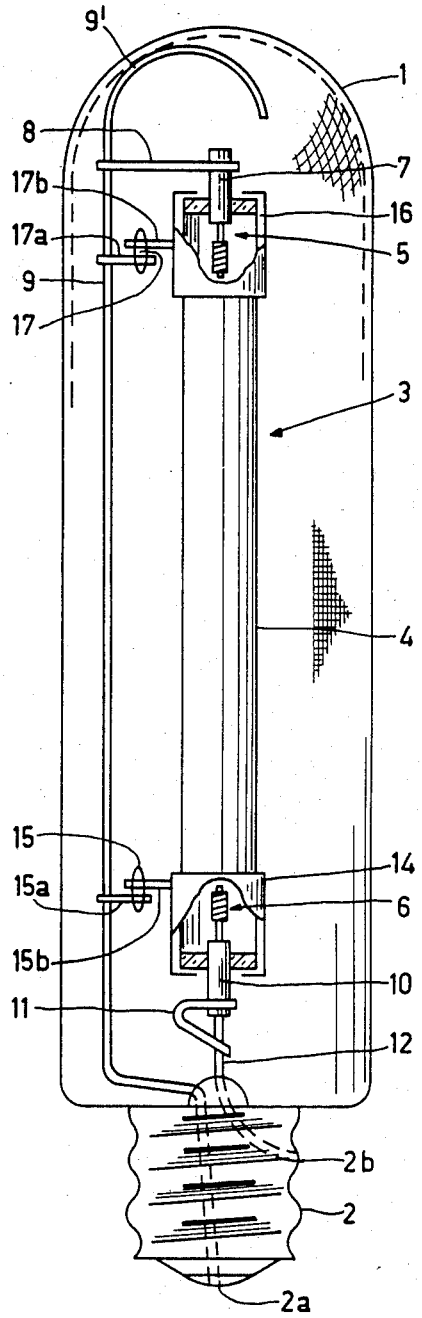
9'
1
8
7
17b
16
17a
5
9
17
3
4
15
14
15a
6
15b
10
11
12
2b
2
2a

HIGH PRESSURE DISCHARGE LAMP WITH ARC TUBE HEAT SHIELD

This is a continuation of application Ser. No. 559,590, filed Dec. 8, 1983, now abandoned.

BACKGROUND OF THE INVENTION

The invention relates to a high-pressure discharge lamp comprising a discharge envelope or arc tube provided with two electrodes between which a discharge path extends, this lamp further being provided with a cylindrical shield near an end of the discharge envelope around and at a certain distance form the discharge envelope.

A lamp of the kind mentioned in the opening paragraph is known from U.S. Pat. No. 4,173,728. Cylindrical heat shields around the discharge envelope near an end thereof are known means for influencing the temperature of the end of the discharge envelope, more particularly in lamp types in which the lamp envelope contains an excess of a filling constituent. In such a situation, the temperature of the constituent present in excess in fact determines the vapor pressure of this constituent in the discharge envelope.

In general, such cylindrical shields are made of metal, such as Ta, Nb, Mo, because of the high resistance to heat and the high reflective power. Such shields are generally provided on or against the wall of the discharge envelope either directly or indirectly by means of a heat-conducting intermediate layer. It is then found that the temperature control very strongly depends upon the presence or absence of a good mechanical contact between the shield and the discharge envelope throughout the envelope circumference, which results in that in practical lamps a high degree of reproducibility of the temperature control and hence of the temperature adjustment is hardly possible.

The U.S. Pat. No. 4,173,728 provides a solution in which the cylindrical shield is arranged at a certain distance from the discharge envelope throughout its area. In this manner, a substantially equally effective heat reflection is obtained in combination with a high degree of reproducibility with respect to the temperature control to be attained. In the known solution, the cylindrical shield is directly secured to a rigid current conductor. Experiments have shown that during operation of the lamp this gives rise to migration of filling constituents through the wall of the discharge envelope. The phenomenon of migration has a detrimental effect on lamp properties, such as variation of the color point of the emitted radiation and increase of the arc voltage, and mostly results in shortening the life of the lamp.

SUMMARY OF THE INVENTION

The invention has for its object to provide means for preventing or at least reducing migration. For this purpose, a lamp of the kind mentioned in the opening paragraph is characterized in that the cylindrical shield is secured so as to be electrically insulated from current-conveying parts.

Due to the electrical insulation between shield and current-conveying parts, potential differences between the cylindrical shield and the discharge space near the shield have proved to remain limited. It has been found that this inhibits migration through the wall of the discharge envelope of filling constituents, while at the same time current-conveying parts remain suitable to be used as mechanical securing means.

Preferably, the cylindrical shield is mechanically connected by means of a glass bead to a rigid current-supply conductor. Such a construction has the advantage that it is simple and very robust.

In an advantageous embodiment of a lamp according to the invention, the distance between the cylindrical shield and the wall of the discharge envelope is at least 1 mm and at most 5 mm. In this manner, a very reproducible and effective temperature control is attained.

The invention can be used in each type of high-pressure discharge lamp both in cases of use of a ceramic discharge envelope and in cases of use of a discharge envelope of hard glass or of quartz glass. The invention is more particularly suitable for high-pressure sodium discharge lamps and for high-pressure metal halide lamps.

An embodiment of a lamp according to the invention will be described with reference to a drawing.

BRIEF DESCRIPTION OF THE DRAWING

The sole FIGURE is a side view, partly in section, of a lamp having two heat shields according to the invention.

DESCRIPTION OF THE PREFERRED EMBODIMENT

In the drawing, reference numeral 1 denotes an outer bulb of a lamp according to the invention provided with a lamp cap 2. A discharge envelope 3, shown partly broken away, with a radiation-transparent wall 4 is located inside the outer bulb. The discharge envelope 3 is provided with a first electrode 5 and a second electrode 6, between which a discharge path extends. The electrode 5 is electrically connected through a lead-in conductor 7 and a current conductor 8 to a rigid current-supply conductor 9. The rigid current-supply conductor 9 is connected by one end to a first connection contact **2*a* of the lamp cap 2, the other end having the form of a supporting bracket 9' which bears on the outer bulb. The electrode 6 is electrically connected through a lead-in conductor 10 and a flexible electrically-conducting wire 11 to a rigid current-supply conductor 12, which is mechanically connected directly to the lead-in conductor 10. The rigid current-supply conductor 12 is connected to a second connection contact 2*b* of the lamp cap 2**.

The discharge envelope is provided near each of its ends with a cylindrical heat shield 14, 16, which is arranged to surround at a certain distance the discharge envelope. The shield 14 is mechanically secured by means of connection rods **15*a* and 15*b* to the rigid current-supply conductor 9. The connection rods 15*a* and 15*b* are electrically insulated from each other by means of a glass bead 15. In an analogous manner, the shield 16 is secured by means of connection rods 17*a* and 17*b* and a glass bead 17 to the rigid current-supply conductor 9. Thus, it is achieved that each cylindrical shield 14 and 16**, respectively, is mechanically secured to a current-conveying part of the lamp, but is electrically insulated therefrom.

Alternatively, the electrically insulating glass bead may be provided directly on the rigid current-supply conductor so that a single connection rod per cylindrical shield is sufficient.

Another construction possibility is that the securing rods are secured to an adjacent lead-in conductor. Especially in the case in which the lead-in conductor is a thin pin or rod, this possibility is very suitable.

The lamp described has a discharge envelope 3 with a ceramic wall 4 made of aluminum oxide sintered to compactness. The electrodes 5 and 6 are made of tungsten, while the lead-in members 7 and 10 are in the form of niobium sleeves. The cylindrical shields 14 and 16 are made of tantalum and are located throughout their area at a distance of approximately 1.5 mm form the wall of the discharge envelope. Other suitable materials for the cylindrical shiels are inter alia molybdenum, niobium and titanium. The discharge envelope has a filling comprising 10 mg of amalgam, of which 76.5% by weight is mercury and 23.5% by weight is sodium. Besides mercury and sodium, the discharge envelope contains xenon, which in the inoperative condition of the lamp (approximately 300K) has a pressure of 80 kPa. The lamp is suitable to be operated at an alternating voltage source of 220 V, 50 Hz, by means of a stabilization ballast with impedance of 148Ω. The power consumed by the lamp in the operative condition is 100 W.

During an operating life of more than 2000 hours, the color point, expressed in x- and y-co-ordinates, of the emitted radiation has changed as follows:

| | x | y |
|---|---|---|
| 500 hours | −.483 | −.419 |
| 1000 hours | −.492 | −.420 |
| 2000 hours | −.505 | −.418 |

The arc voltage then increased by 20 V.

What is claimed is:

1. A high-pressure discharge lamp comprising:

an outer sealed envelope, an elongated discharge envelope having two ends, disposed within said outer envelope, two electrodes arranged within said discharge envelope, between which electrodes a discharge path extends in normal operation, each electrode being disposed near a respective end of said discharge envelope, current-conveying parts, including two rigid current-supply conductors supported in said outer envelope, means for connecting each conductor to a respective electrode, and an electrically conducting cylindrical heat shield surrounding and spaced from an end of the envelope, characterized by comprising means directly engaging one only of said conductors for mechanically supporting said shield, said means for supporting insulating said shield electrically from said conductors and said means for supporting being free from contact with said discharge envelope and being the sole mechanical support for said shield.

2. A lamp as claimed in claim 1, characterized in that all parts of said heat shield are spaced from said discharge envelope a distance of at least 1.0 mm, and said shield is spaced from the wall of the discharge envelope a distance of at most 5 mm.

3. A high-pressure discharge lamp comprising:

an outer sealed envelope, an elongated discharge envelope having two ends, disposed within said outer envelope, two electrodes arranged within said discharge envelope, between which electrodes a discharge path extends in normal operation, each electrode being disposed near a respective end of said discharge envelope, current-conveying parts, including two rigid current-supply conductors supported in said outer envelope, means for connecting each conductor to a respective electrode, and a respective metallic cylindrical heat shield surrounding and spaced from each end of the envelope, characterized by comprising means directly engaging one only of said conductors for mechanically supporting said shields, said means for supporting insulating said shields electrically from said conductor and from each other, said means for supporting being the sole mechanical support for each shield, and said means for supporting comprising a respective metallic element which is the sole mechanical connection to each shield, and insulating means supporting each element from said one of said conductors.

4. A lamp as claimed in claim 3, wherein said means supporting each element consists of two further metallic elements secured directly to said one of said conductors, and a respective glass bead connecting each metallic element to a respective further metallic element.

5. A lamp as claimed in claim 4, characterized in that all parts of said heat shield are spaced from said discharge envelope a distance of at least 1.0 mm, and said shield is spaced from the wall of the discharge envelope a distance of at most 5 mm.

6. A lamp as claimed in claim 3, characterized in that all parts of said heat shield are spaced from said discharge envelope a distance of at least 1.0 mm, and said shield is spaced from the wall of the discharge envelope a distance of at most 5 mm.

7. A high-pressure discharge lamp comprising:

an outer sealed envelope, an elongated discharge envelope having two ends, disposed within said outer envelope, two electrodes arranged within said discharge envelope, between which electrodes a discharge path extends in normal operation, each electrode being disposed near a respective end of said discharge envelope, current-conveying parts, including two rigid current-supply conductors supported in said outer envelope, means for connecting each conductor to a respective electrode, and a respective metallic cylindrical heat shield surrounding and spaced from each end of the envelope, characterized by comprising a respective single metallic connection rod fixed to and extending from each shield, said rods being the sole mechanical support for the respective shields, and means directly engaging one only of said conductors for mechanically supporting said rods and insulating said rods electrically from said conductor and from each other.

8. A lamp as claimed in claim 7, characterized in that said means for mechanically supporting and insulating said rods consist of two further metallic connection rods secured directly to said one of said conductors, and two glass beads, each connecting a respective rod to a respective further rod.

9. A lamp as claimed in claim 8, characterized in that all parts of said heat shield are spaced from said discharge envelope a distance of at least 1.0 mm, and said shield is spaced from the wall of the discharge envelope a distance of at most 5 mm.

10. A lamp as claimed in claim 7, characterized in that all parts of said heat shield are spaced from said discharge envelope a distance of at least 1.0 mm, and said shield is spaced from the wall of the discharge envelope a distance of at most 5 mm.

* * * * *